US005336331A

United States Patent [19]

Jenkins

[11] Patent Number: 5,336,331

[45] Date of Patent: * Aug. 9, 1994

[54] CONTINUOUS CONDENSER BACKFLUSH AND CLEANING SYSTEMS AND METHODS FOR USE THEREOF

[76] Inventor: Jerry Y. Jenkins, 583 Parlange Loop, La Place, La. 70068

[ * ] Notice: The portion of the term of this patent subsequent to Aug. 24, 2010 has been disclaimed.

[21] Appl. No.: 97,189

[22] Filed: Jul. 27, 1993

Related U.S. Application Data

[63] Continuation-in-part of Ser. No. 824,170, Jan. 22, 1992, Pat. No. 5,238,502.

[51] Int. Cl.[5] ..... B08B 9/02; F28G 3/00

[52] U.S. Cl. ..... 134/22.11; 134/23; 134/24; 134/34; 134/37; 134/172; 165/95

[58] Field of Search ..... 134/22.1, 22.11, 22.12, 134/22.18, 18, 23, 24, 34, 37, 172, 180, 181; 122/379, 396; 165/95

[56] References Cited

U.S. PATENT DOCUMENTS

| | | | |
|---|---|---|---|
| 1,589,980 | 6/1926 | Miller et al. | 165/95 |
| 3,242,872 | 3/1966 | Thompson | 210/391 |
| 3,903,912 | 9/1975 | Ice, Jr. et al. | 134/172 X |
| 4,169,792 | 10/1979 | Dovel | 210/793 |
| 4,234,993 | 11/1980 | Kintner | 165/95 |
| 4,269,264 | 5/1981 | Goeldner | 134/22.12 X |
| 4,447,323 | 5/1984 | Jackson | 210/158 |
| 4,531,571 | 7/1985 | Moss | 165/95 X |
| 4,542,785 | 9/1985 | Bagnall et al. | 165/95 |
| 4,705,057 | 11/1987 | Mohr et al. | 134/180 |
| 5,060,600 | 10/1991 | Brown et al. | 134/22.11 X |
| 5,186,240 | 2/1993 | Kennon et al. | 134/172 X |

*Primary Examiner*—Richard O. Dean
*Assistant Examiner*—Saeed T. Chaudhry
*Attorney, Agent, or Firm*—Keck, Mahin & Cate

[57] ABSTRACT

A continuous condenser backflush system includes a hollow wand attached perpendicularly to a hollow shaft. The wand is moved in lateral increments across the condenser face. The wand is retracted from the condenser face for moving laterally to a new position before again being extended to the condenser face to collect and dispose of the trash caught under the wand. Trash caught on the condenser face is flushed by a stream of water back through the shaft to a mesh basket where it is separated from the water. A pump may be provided on the shaft for injecting and circulating cleaning fluids (such as chemical and/or abrasive fluids) through the condenser. A similar wand system may be provided on the remote face of the condenser to receive the fluids and return them to a recovery tank for recycling. The pump may also circulate dehumidified air through the system to keep the condenser dry when the cooling water circulating pump is shut down. A method of using the system is described.

34 Claims, 6 Drawing Sheets

CONTINUOUS CONDENSER BACKFLUSH AND CLEANING SYSTEMS AND METHODS FOR USE THEREOF

RELATED APPLICATION

This application is a continuation-in-part of Ser. No. 07/824,170, filed Jan. 22, 1992, U.S. Pat. No. 5,238,502.

FIELD OF THE INVENTION

This invention relates to a continuous condenser backflush system and condenser tube cleaning system using a wand which moves incrementally across the condenser face, and methods for use thereof for cleaning accumulated trash from the face of a condenser and for cleaning condenser tubes.

BACKGROUND OF THE INVENTION

Known systems do not continuously clean the face or the tubes of a condenser with trash removal, as described. Known systems include that described in Ice, Jr. et al., U.S. Pat. No. 3,903,912 which describes a method and apparatus for cleaning heat exchangers in which a pair of thin lances move through tubes of the heat exchanger, successively. Goeldner, U.S. Pat. No. 4,269,264, which describes a method and apparatus for cleaning heat exchanger tubing by passing cleaning brushes through the heat exchanger tubes in a flow of high pressure backflush fluid.

Moss, U.S. Pat. No. 4,531,571, describes a method for removing chlorinated treatment of selected condenser tubes which are biologically fouled.

Brown et al., U.S. Pat. No. 5,060,600, describes a condenser operation with at least one tube separately connected to inlet and outlet water connections for chemical treatment.

Miller, U.S. Pat. No. 1,589,980, is directed to a washer which directs a stream of water, under pressure, between the condenser tubes. The washer travels in a circle and all the tubes in the circumference of such circle are washed consecutively.

Thompson, U.S. Pat. No. 3,242,872, describes water supply inlet structures including self-cleaning screens. A cylindrical revolving screen is described, including jet cleaning means positioned inside the revolving screen. Kintner, U.S. Pat. No. 4,234,993, describes a system for cleaning the tubes of a condenser or other heat exchanging unit by circulating sponge balls therethrough using a circulating pump. A screen assembly includes four vertical screens about 90° apart. By turning the screens through 180°, the screens are completely flushed of debris without the need to remove the balls or to stop circulation of the balls during the screen cleaning operation.

Jackson, U.S. Pat. No. 4,447,323, describes a trash rake for cleaning the bars of a water intake bar screen. Dovel, U.S. Pat. No. 4,169,792, discloses a water intake device comprising a substantially cylindrical rotatable screen adapted to be at least partially submerged in a body of water. The screen is rotated and a water supply conduit communicating with the interior of the screen receives water flowing through the screen. Means for backflushing a section of the screen as the screen moves so as to clear or remove objects or fish caught on the exterior surface of the screen is described. Bagnall et al., U.S. Pat. No. 4,542,785, describes a rotating cleaner for an agricultural harvester heat exchanger which includes a suction device to remove air-borne agricultural material which settles on the screen of the heat exchanger.

None of these known methods satisfactorily allows continuous backflushing of the condenser face or continuous cleaning of the condenser tubes, using a system which is moved incrementally across a water-cooled condenser face, as described herein. According to prior known methods, the circulating pump for the cooling water must be turned off to clean the condenser face. Cleaning may require as long as three weeks or more for a typical large condenser having 12,000 to 15,000 tubes to be cleaned. Each tube must be cleaned individually by pressure washing and/or brushing. Cleaning is necessary when the cost of increased energy requirements due to partially clogged condenser tubes exceeds the cost of closing the equipment for cleaning.

SUMMARY OF THE INVENTION

A continuous condenser backflush system of the invention includes a hollow wand for removing trash from a face of a condenser cooled with a stream of water, such as river water, a hollow shaft attached to the hollow wand for conveying the trash to a remote location, thrusting gears for extending the wand to and retracting the wand from adjacent the condenser face and apparatus for moving the wand laterally to an incrementally different position while the wand is retracted from the condenser face. When the condenser face is substantially square or rectangular in shape, the wand is moved stepwise in lateral increments across the condenser face on a carriage riding on a track across the condenser face. When the condenser face has parallel sides and arcuate ends, a spring-loaded extension may be added to each end of the wand. The spring loaded extension moves across the arcuate end portion as the wand is moved stepwise laterally across the rectangular part of the condenser face or angularly around the central portion of the condenser face.

Valves are provided for opening when the wand is extended adjacent the condenser face to allow trash on the condenser face to be carried by a stream of water to a remote location and for closing before moving the wand to the adjacent position for cleaning an adjacent portion of the condenser face. After the trash under the face of the wand is conveyed to a remote location in the stream of water, for separation from the water, the valve is closed, the wand retracted from the condenser face and moved to the next stepwise or angular position before being extended to the condenser face again in a different position for removing the trash from the condenser face at the different position. Automatic controls allow the condenser face to be cleaned continuously.

Manual or automatic controls enable successively positioning the wand adjacent the condenser face, opening the valve, closing the valve, retracting the wand, moving the wand and extending the wand to adjacent the condenser face again in a different position. Automatic controls allow the condenser face to be cleaned continuously.

The stepwise mechanism includes a carriage for supporting the wand, a mechanism for extending the wand adjacent the condenser tube sheet and a mechanism for moving the carriage on a track, stepwise across the condenser tube sheet.

In another embodiment, the condenser tubes are cleaned by passing chemical or abrasive cleaning fluid forward through the wand and through the condenser tubes into a similar system adjacent the opposite condenser face on the remote side of the condenser tubes, to collect the cleaning fluid and recycle it through a recovery tank.

Methods of using the apparatus are also described.

It is an object of the invention to provide a substantially continuous backflush system for cleaning the face of a condenser which is cooled by water which may include trash or other debris.

It is another object of the invention to provide a system for cleaning condenser tubes using chemical or abrasive fluids which may be recycled for further use.

It is a further object of the invention to provide a method for using the continuous systems described.

DETAILED DESCRIPTION OF THE PREFERRED EMBODIMENTS

This application is a continuation-in-part of Ser. No. 07/824,170, filed Jan. 22, 1992, the entire disclosure of which is incorporated herein by reference.

Ser. No. 07/824,170 is directed to an apparatus and method for rotating a wand stepwise around a water-cooled substantially circular condenser face or portion of a condenser which can be cleaned by using a rotating wand for removing accumulated trash from the condenser face. The subject application includes cleaning different shapes of condenser face, such as square or rectangular condenser faces or condenser faces of other shapes, including condenser faces having arcuate ends. Cleaning trash from a condenser face, cleaning condenser tubes using chemicals and/or abrasives and drying condenser tubes with air are described below. It will be appreciated by those skilled in the art that the system requires a single type of control system whether the wand is moved stepwise angularly around the condenser face or stepwise laterally across the condenser face.

A condenser backflush system of the invention is advantageously used for cleaning a condenser cooled by river water, or other water which may carry trash with it. The system operates continuously, without needing to close down the condenser unit while the condenser face is being cleaned.

Water-borne trash collects continuously on a condenser face in which the condenser tubes are cooled with, for example, river water. If the trash is not removed from the condenser face, the efficiency of the condenser is seriously impaired as the volume of water flow reaching the tubes to provide the necessary cooling may be substantially reduced and the cooling may become inefficient. Inadequate cooling may result.

The method and apparatus described herein solves the long standing problem of continuous cleaning of a condenser face. This system is used, for example, in power plants and other installations where water from natural sources, such as river water which may carry trash, is used for cooling the condensers.

Figure 1:
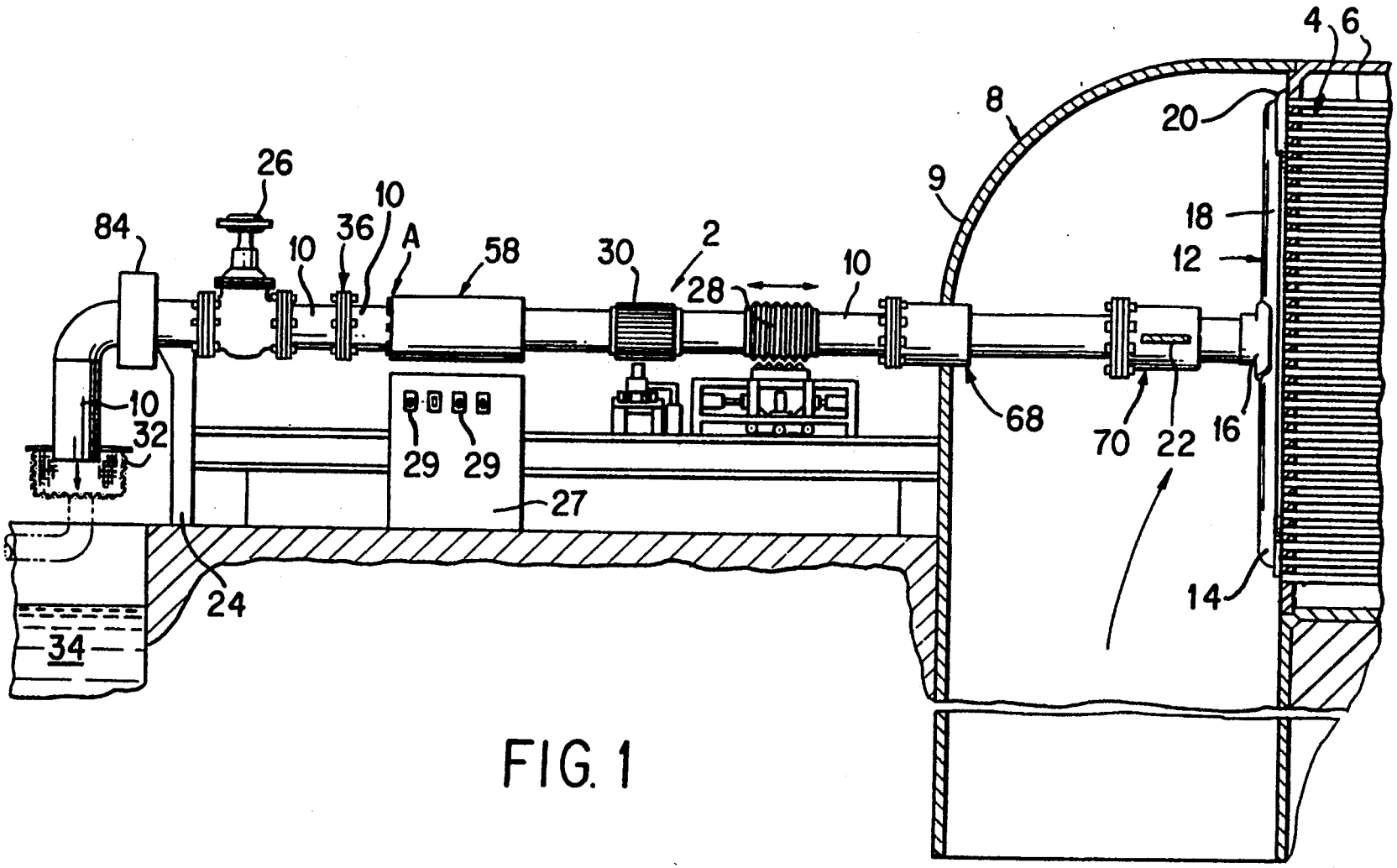
FIG. 1 is a schematic side elevational view of a condenser backflush system for a condenser face.
Figure 2:
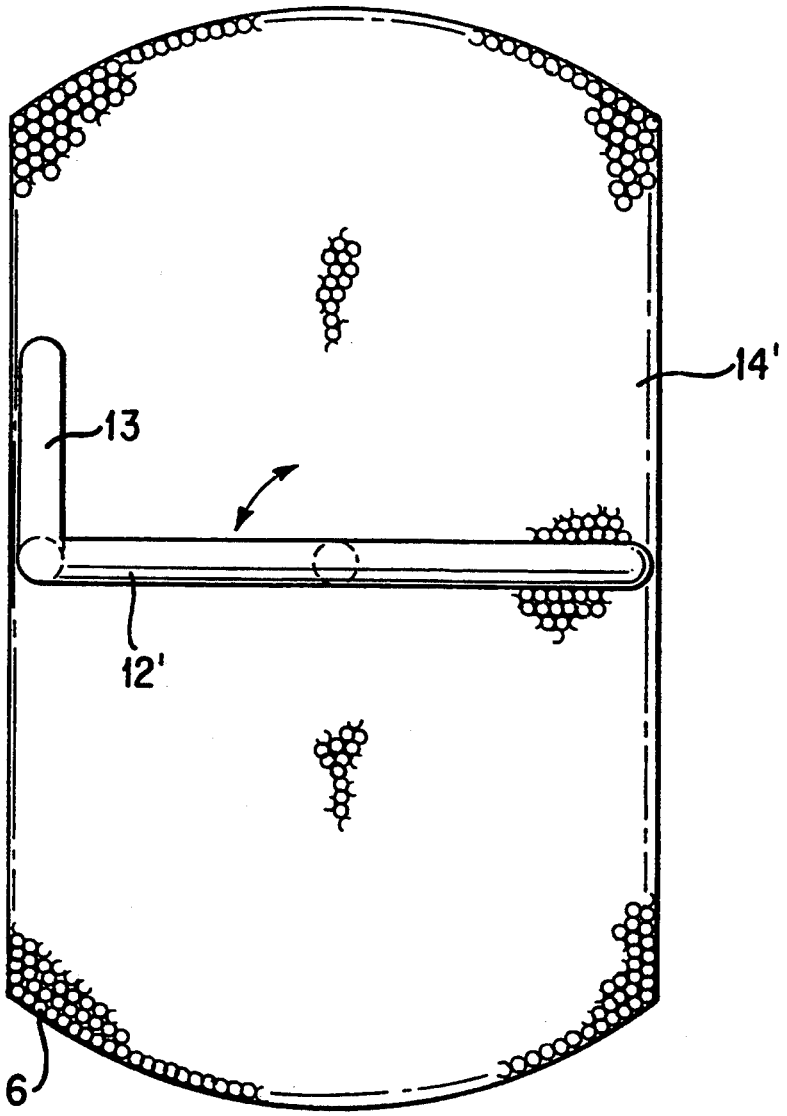
FIG. 2 is a schematic elevational view of a condenser face of FIG. 1 showing the position of a wand with extension members as shown in FIG. 3, in position on the condenser face.

With reference to FIGS. 1 to 7, in which like numerals represent like elements. FIG. 1 illustrates a system 2 according to the invention. Condenser 4 which includes a plurality of condenser tubes 6 is contained in a housing 8. Overboard tube 10, which is a hollow shaft 10 enters housing 8. Wand 12, attached substantially perpendicularly, through joints, to overboard tube 10, is positioned against condenser face 14 for removing trash. Wand 12 extends across the condenser face, covering the ends of the condenser tubes from top to bottom (or from side to side), of the condenser face, as shown in FIGS. 1 and 2. Overboard tube 10, which may be a hollow iron pipe is attached to wand 12 perpendicularly at joint 16. Wand 12, in non-limiting example, as shown in FIGS. 1 to 7, may be a half-section of a straight elongated pipe 18 having a rubber or plastic edge facing 20 for providing close contact to condenser face 14. Wand 12 may have other shapes or configurations, as known to one skilled in the art.

Overboard tube 10 is supported in horizontal orientation by wall 9 of housing 8, by support 22 which extends to wall 9 of housing 8 and by support 24. Other supports may be used along the length of shaft 10, as appropriate. Housing 8 contains the cooling water inflow through the condenser tubes. The cooling water is usually river water, which generally carries trash with it.

Wand 12 is preferably made of a section of cylindrical iron pipe, such as 6-inch diameter iron pipe, cut longitudinally to form a half-cylinder and closed at both ends. The cut edge of pipe 18 is covered with a rubber facing 20 for providing a close fit against the condenser tubes. Hollow shaft 10, which may be an 8-inch diameter iron pipe, enters wand 12 substantially at a mid-point thereof.

Gear 30, shown in FIG. 1, for incrementally moving wand 12 laterally and thrust gear 28 for injecting and retracting wand 12 are known in the art. Can bearing 68 is similar to can bearing 70. Expansion joint 58, allows for up to about 8 in. of movement toward and away from the condenser face. The expansion joint may extend up to about 30 in. in length. A telescoping joint may be used in place of expansion joint assembly 58. Gear 30, expansion joint 58 and can bearing 70 are described in detail in patent application Ser. No. 07/824,170, filed Jan. 22, 1992, the disclosure of which is incorporated herein by reference.

Figure 3:
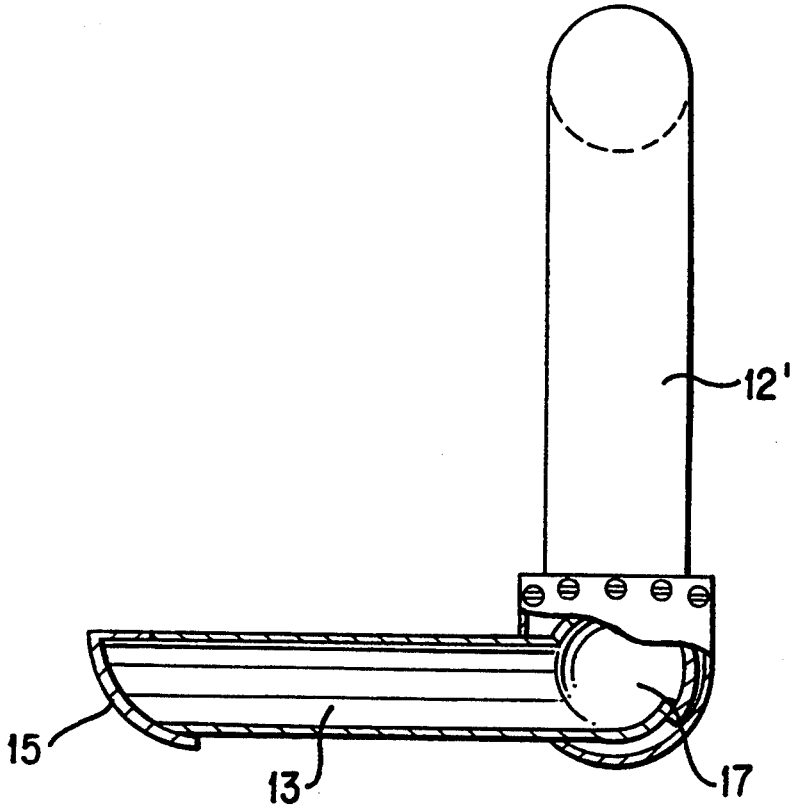
FIG. 3 is a schematic elevational view of the face of a wand having spring loaded extension members.

In one embodiment, a subsidiary wand may be connected to the main wand for covering arcuate ends of a condenser face, as illustrated in FIGS. 2 and 3, and discussed below. FIG. 2 illustrates a face 14' of a condenser which is generally rectangular in shape with arcuate ends. As described in Ser. No. 07/824,179, filed Jan. 22, 1992, if the condenser face is substantially circular in shape, a straight wand is rotated around the face in angular increments to clean water-borne trash from the condenser face. For a condenser face 14', as illustrated in FIG. 2, a wand 12' may be angularly rotated around the condenser face 14' for cleaning the circular portion of the face and an extension 13 may be added to the wand for cleaning the arcuate ends of the condenser face 14'. An extension 13 may be present at each end of wand 12'.

FIG. 3 illustrates an elevational end view of a modified wand 12' having an extension 13 attached to an end of wand 12' and spring-loaded to allow cleaning of the arcuate ends of a condenser face shaped such as that shown in FIG. 2. Extensions 13 each ride on a teflon shoe for smoothness in operation. End 15 of extension 13 is substantially arcuately shaped and follows the circumference of the arcuate ends of the condenser face as wand 12' is moved angularly around or stepwise across the condenser face, thus covering substantially the entire end portion sequentially. As illustrated in FIG. 3, joint 17 between wand 12' and extension 13 is a rotary joint in which extension 13 swivels freely with respect to wand 12, allowing curved end 15 to follow the circumference of the arcuate ends of the condenser face. If there is only one arcuate end on the condenser face, then an extension 13 is only needed on one end of wand 12.

Figure 4A:
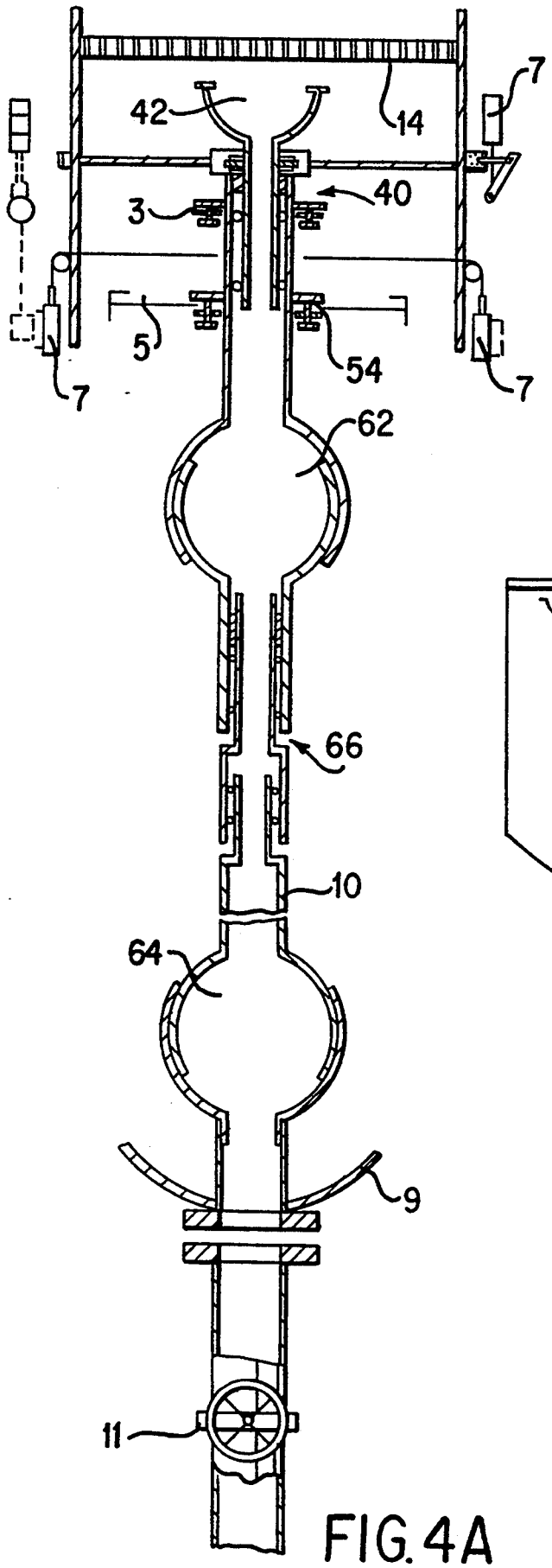
FIG. 4A is a schematic cross-sectional view of the apparatus for moving the wand across the condenser face.
Figure 4B:
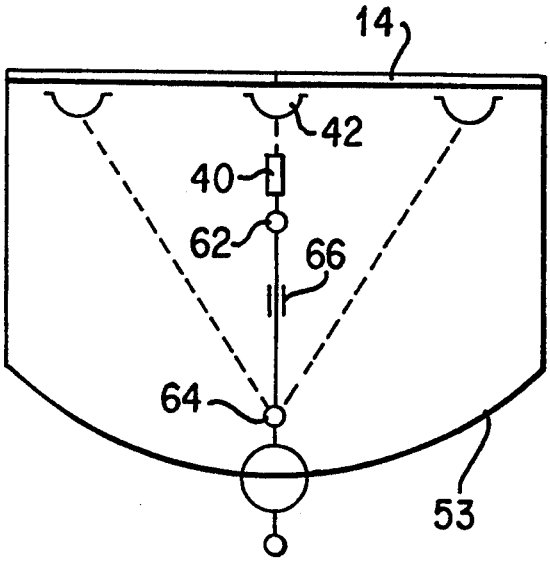
FIG. 4B is a schematic view showing the positions of the parts of the apparatus shown in FIG. 4A with the wand at different positions adjacent the condenser face.

Condenser faces 14, 14', which are shown in FIGS. 2 and 4B respectively, include the end faces of a plurality of individual condenser tubes 6 shown in FIG. 2. Wand 12 rests against condenser face 14, parallel to the sides of the condenser face. Shaft 10 enters wand 12 at substantially a mid-point thereof and is secured to wand 12 by collar 16 (shown in FIG. 1). Wand 12 is moved across the face of the condenser in adjacent stepwise increments, to cover the entire face of the condenser. Each successive position of the wand is adjacent the previous position to allow removal of trash over the entire condenser face.

When the condenser face has shaped ends, such as condenser face 14', shown in FIG. 2, the wand 12' may be moved either stepwise or angularly and the spring loaded end portions 13 sweep the shaped ends of condenser face 14' and water-borne trash is removed therefrom by backflush.

The mechanisms using a wand which moves laterally stepwise across a condenser face, shown in FIGS. 4A through 7, are used in conjunction with the operating and control systems shown in FIG. 1 and also applied to FIGS. 2 to 4 in which a wand moves angularly stepwise around a condenser face.

When the condenser face 14 is rectangular, a straight elongate wand is moved incrementally laterally across the rectangular face to clean the face. The operation of a system useful for practicing the method of the invention when the condenser face is rectangular will be described with respect to FIGS. 4A and 4B. Valve 11, including any associated valves for controlling the fluid flow through shaft 10, may be a diaphragm valve, piston valve, gate valve, gate valve with piston or other valve known in the art for accomplishing the described function of valve 11.

FIG. 4A shows wand 42 close to condenser face 14 and want 42 able to move on carriage 3 moving on track 5 by means of hydraulic pistons 7 controlled from control panel 27 illustrated in FIG. 1. Slip joint 40, together with slip joint 66, allow the wand to be thrust toward and away from condenser tube face 14. Swivel joints 62 and 64 allow the angle of overboard tube 10 to be adjusted to follow the position of wand 42 across the condenser face. Overboard tube 10, which does not rotate, is supported by circulating water inlet pipe 9, and a control valve 11 for adjusting the flow of water through overboard tube 10 is located outside the circulating water inlet pipe. The carriage and track mechanism on which the wand moves is all located within the circulating water inlet pipe. The valve and control panel are outside the circulating water inlet pipe. Valve 11 controls the flow of water through the system and allows for complete shut-down if necessary.

FIG. 4B schematically illustrates the stepwise movement of the wand across the condenser face, showing use of swivel joints 62, 64 and slip joints 40 and 66. The solid line shown want 42 at a mid-point of condenser face 14, and the broken lines show, schematically, the approximate position of wand 42 at each side of condenser face 14. Joints 40 and 66 are adjustable according to the distance of swivel joints 64 from the wand on the condenser face.

With reference to FIGS. 1 and 4A, which show the operation of the apparatus, schematically, switches 29 are used to initiate preparation of each stage of the backflush operation. Starting from the position shown in FIG. 4A, in which the wand 42 resets against condenser face 14 at the end of a cycle of removing trash from the condenser, switches 29 are activated, either manually or automatically, to operate each stage of the cycle, as follows. Valve 11 is opened and wand 42 is retracted from adjacent condenser face 14. The hollow shaft forming overboard tube 10 moves rearward by operation of thrusting gear 40, operated by piston 7' thus retracting wand 42 from condenser face 14. The thrusting gear is disengaged and reset for moving the wand forward to the condenser face after the wand has been moved laterally. Lateral movement mechanism 54 is engaged and wand 42 is moved stepwise parallel to the condenser face 14, by operation of pistons 7, through an increment generally corresponding to the width of the wand. Lateral movement mechanism 54 is then disengaged and the thrusting mechanism is engaged. The thrusting mechanism enables want 42 to move forward about 3 to 8 inches, preferably about 5 inches, to rest against the condenser face. Valve 11, which may be a diaphragm valve, piston valve, gate valve or other valve known in the art is opened to allow water and trash to flow from the area of the condenser face covered by wand 42 rearward through overboard tube 10 to outlet basket 32. Outlet basket 32 is a wire mesh basket which holds the trash while the water carrying the trash passes through basket 32 into pond 34 or is otherwise carried away. When the trash underlying wand 42 has been removed, valve 11 is again closed and wand 42 is again retracted from the face of the condenser and the cycle repeated. The entire condenser face is covered by successive lateral moves by the wand, stepwise across the condenser face.

Figure 5:
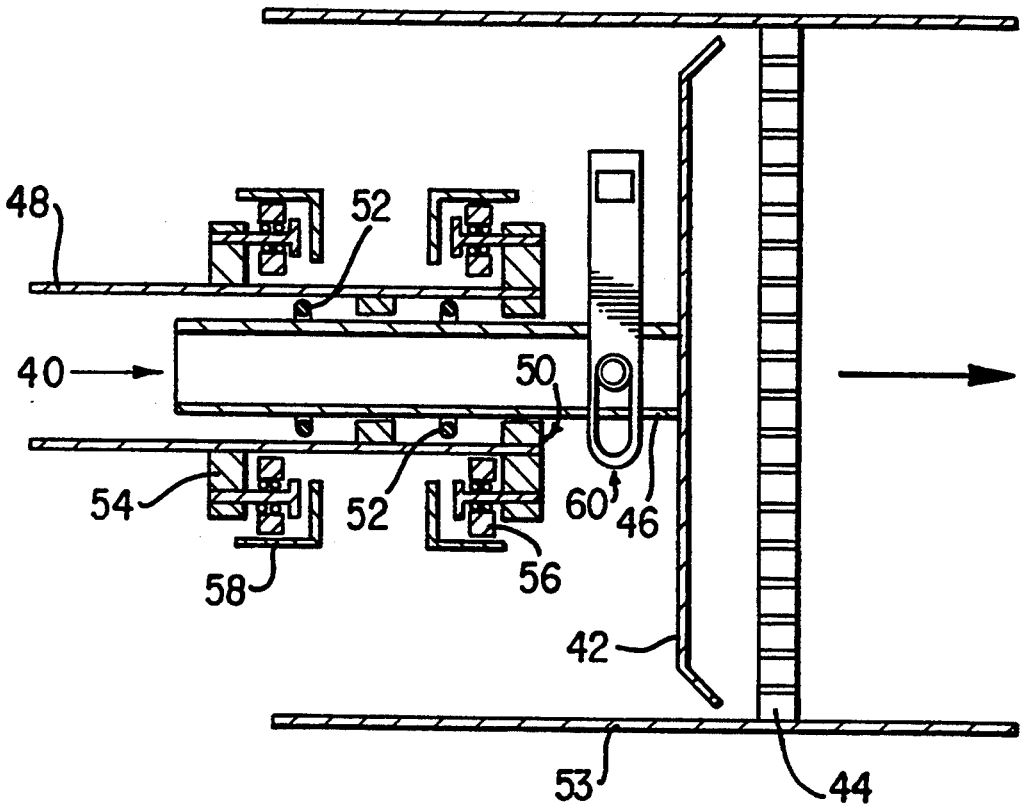
FIG. 5 is a schematic cross-sectional view of the wand and slip joint, shown in FIG. 4A.

FIG. 5 shows slip joint 40 which allows wand 42 to move toward and away from condenser face 44, in detail. Wand 42 is attached to shaft 46 of slip joint 40 which is inserted into an end of overboard tube 48 through which backflush water flows or through which forward pumped water flows, as discussed below with respect to using the system for cleaning the inside of the tubes. Bearings 50 support wand 42 and guide shaft 46 centrally in overboard tube 48, together with O-rings 52. Condenser water box 53 directs water flow to condenser face 44 and through the condenser tubes. Carriage 54 moves on wheels 56 on track 58 to enable side-to-side movement of wand 46 stepwise across condenser face 44. Control rod 60 is connected to the mechanism for controlling the in-and-out movement of wand 46 toward and away from condenser face 44.

Figure 6:
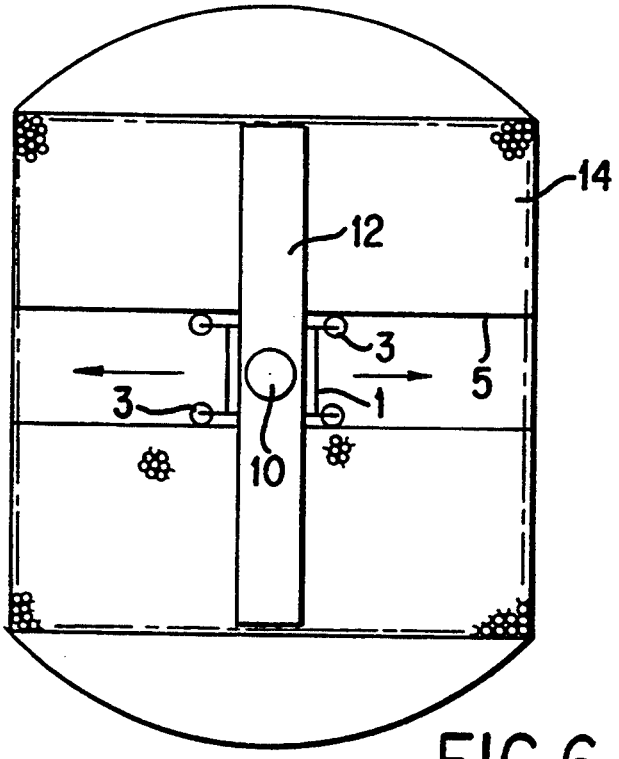
FIG. 6 is a schematic plan view of a condenser face showing the location of the carriage and track for cleaning a rectangular condenser face.

FIG. 6 illustrates carriage 1 supporting wand 12 for movement across condenser face 14, which is generally rectangular in shape. Carriage 1 may move on wheels 3 along track 5, in either direction as shown, or may be moved as known to one skilled in the art. Track 5 extends across the face of the condenser for supporting wand 12 as it moves on carriage 1 in steps from one side of condenser face 14 to the other. At each step, the wand face is moved down onto the condenser face for removal of trash on the condenser face, by backflush, and the wand is moved away from the condenser face and moved one step sideways. The wand face is then again moved down onto the condenser face for removing trash from the end faces of the condenser tubes.

If the condenser face is substantially rectangular in shape, the wand is moved in stepwise increments across the condenser face, as shown in FIG. 6. If the condenser face is of another shape, the wand may be arranged for moving either angularly or stepwise, depending on the shape of the condenser face.

Figure 7:
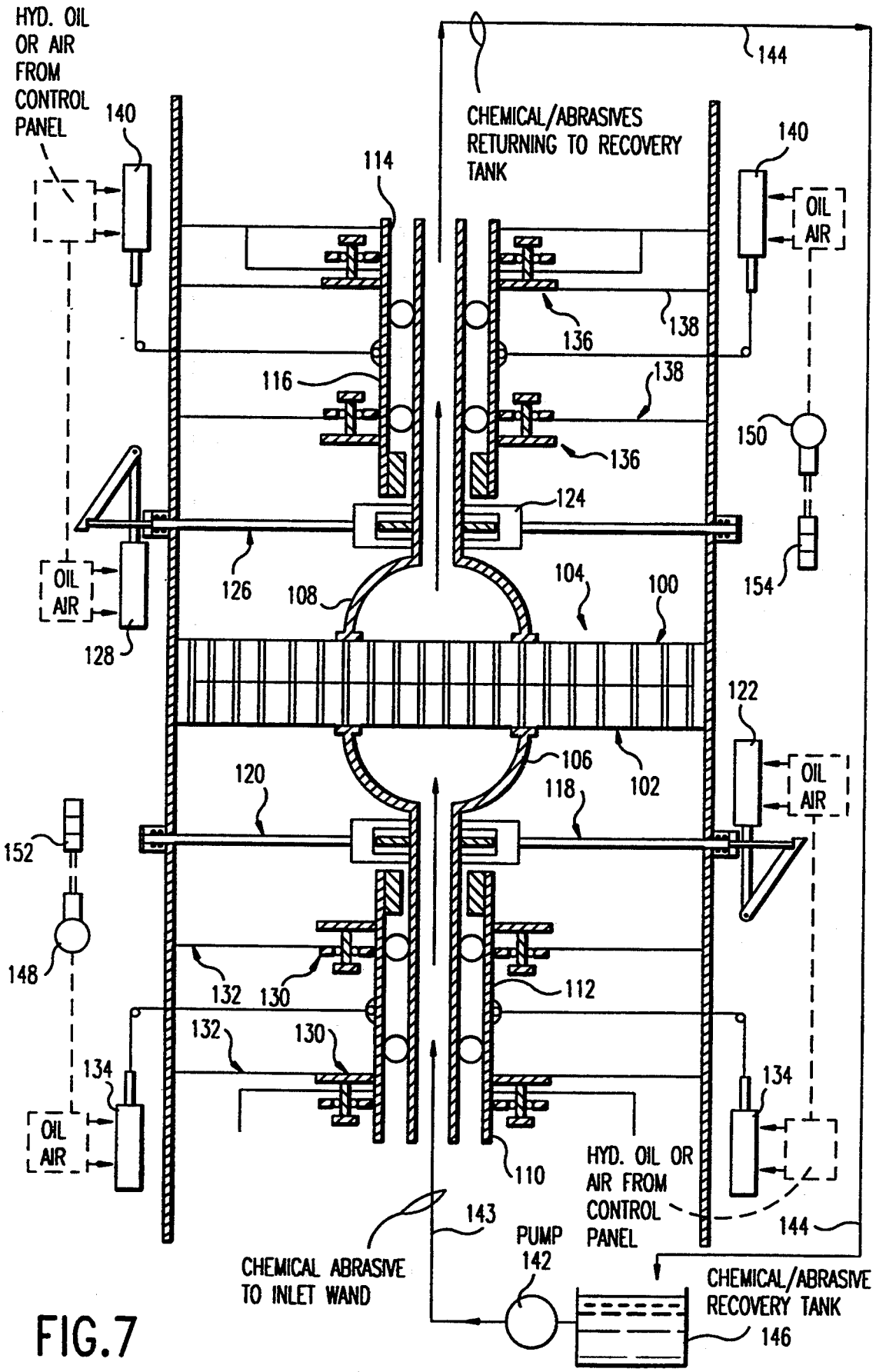
FIG. 7 is a schematic top plan view of a system, similar to that shown in FIG. 4A, extending on both sides of the condenser, for cleaning the condenser tubes using chemicals or abrasives.

In FIG. 7, an adaptation of the apparatus is shown, for using the wand for cleaning the inside of the condenser tubes with chemical or abrasive cleaners and for flushing the condenser tubes with water following such cleaning. A wand system, as described above and illustrated in FIG. 4A, is set up on each side of the condenser tubes, as shown in FIG. 7. The wands are moved in unison opposite each other on both sides of the condenser face. Cleaning fluid is pumped to the wand on one side of the condenser tubes, through the condenser tubes and through the wand on the other side of the condenser tubes before being returned to a recovery tank for again recycling through the system. The system on each side of the condenser tubes may be essentially similar to each other to allow the wands on each side of the condenser to face each other each in contact against one of the condenser faces to allow the fluid to be cycled through the system.

A typical example is shown in FIG. 7 wherein condenser tubes 100, having inlet tube end face 102 and outlet tube end face 104, are contacted by wands 106 and 108, as shown. Wand 106 joins tube 110 through slip joint 112, and wand 108 joins tube 114 through slip joint 116. Control rod 118 controls the in-out motion of wand 106 by means of support bar 120 and hydraulic piston 122. Control rod 124 controls the in-out motion of wand 108 by means of support bar 126 and hydraulic piston 128. Wand 106 moves laterally on carriage 130 which rides on track 132 by means of hydraulic pistons 134. Wand 108 moves laterally on carriage 136 which rides on track 138 by means of hydraulic pistons 140. Pump 142 pumps chemical cleaning fluid, abrasive cleaning fluid or water through line 143, through the system, and the chemical or abrasive cleaning fluids are returned by line 144 to one or more recovery tanks, shown as tank 146. Pump-compressors 148 and 150 supply motive force to move the wands from side to side and toward and away from the condenser face. Control panels 152 and 154 are used to time and synchronize movement of the various parts of the system.

In a method for cleaning trash from a face of a condenser which is cooled with a stream of water, using the apparatus described above, the method includes positioning a hollow wand having an elongated open face in a first position adjacent the condenser face. The wand is in fluid connection with a hollow shaft attached perpendicularly to the wand. An outlet valve of the shaft is opened to enable trash adhering to the condenser face to pass in a stream of cooling water from adjacent the condenser face back through the hollow wand and through the hollow shaft to a remote location. The wand is retracted from adjacent the condenser face when the trash has been removed. The lateral moving mechanism is then used to move the wand stepwise by an increment of 5 to 9 ins., preferably about 6 to 8 ins., and more preferably about 7 ins., to its next position. The wand is then extended to the condenser face in this new position, moved laterally from the previous position. These steps are repeated in succession for continuously cleaning the condenser face. As the wand is moved laterally across the condenser face, sections of the face are successively cleaned of trash.

The outlet valve is closed before retracting the wand for lateral movement. The lateral moving step includes disengaging the lateral moving mechanism, resetting the lateral moving mechanism and reengaging the lateral moving mechanism at a different position. In a typical non-limiting example of operation of the system, the wand is moved in increments of 6 to 8 inches and thrust 4 to 6 inches forward against the condenser face and is retracted 4 to 6 inches therefrom between each successive lateral step.

If required, different portions of the condenser face may be cleaned selectively.

There is a drop in pressure from the condenser inlet to the condenser outlet on the remote side of the condenser. This pressure drop increases with the accumulation of trash. The pressure may be about 6 psi above atmospheric pressure at the inlet of the river water and about 4 psi above atmospheric pressure at the outlet on the remote side of the condenser. This pressure drop pulls the trash against the condenser face. When the valve is open for backflushing, the trash is pulled away from the condenser face and back through the shaft in a stream of water to outlet basket 32, at atmospheric pressure, to keep the condenser face clean and the pressure differential across the condenser substantially constant. This is important because if the trash is allowed to accumulate, the differential pressure between the inlet and outlet is increased and more power is required to pump the water through the condenser tubes, resulting in an increase in the electrical energy used.

Algae, crustaceans and scale may also build up on the condenser face and/or in the condenser tubes. Cleaning methods may use chlorine or chlorine compound containing fluids for removal of crustaceans, algae and/or scale.

A suitable pump 142 for injecting and circulating fluids is known to those skilled in the art. Pump 142 is used for injection and circulation of cleaning fluids, such as chemical and/or biocidal solutions, which are pumped to the condenser face and/or through the condenser tubes for cleaning sediment, scale, algae and/or crustaceans from the condenser face and tubes. This cleaning method is fast and economical. In another method, the cleaning fluid is injected using pump 84, shown in FIG. 1, while the system is operating and the plant does not need to be shut down for cleaning. The environmental impact of cleaning is greatly reduced by injecting the cleaning fluids during operation of the system as the cleaning fluid is diluted with the river water immediately after passing through the tubes. If the plant needs to be shut down while chemical cleaning takes place, the circulating pump only needs to be shut down for 12 to 24 hours. The system described enables cleaning at a low monetary cost, little environmental impact and little loss of continuity of operation.

In another embodiment, the cleaning fluid may be an abrasive-containing fluid in place of, or in addition to, the chemical cleaning fluid described above. This method can also be used while the plant is operating, as discussed above. Abrasives such as sand, fine gravel, plastic beads or other material known in the art, may be injected using pump 142 and circulated to the condenser face and through the condenser tubes as discussed above. In this embodiment, the condenser face and tubes are cleaned of scale etc., abrasively. The environmental impact is low or zero when abrasive cleaning is carried out using sand or gravel, particularly when the cleaning process is carried out while the cooling water is circulating.

The apparatus and method described is time-saving since the condenser does not need to be shut-down for long periods during periodic cleaning and energy-saving due to the lack of accumulation of trash, including algae etc. on the condenser face.

If a condenser, such as a stainless steel condenser is shut down for a period of time, without cooling water circulating through the condenser tubes, the condenser can become rusty from humid air in the tubes or other problems may occur with disuse. To prevent chloride-related problems, or other problems, the system using a wand of the invention may be left running when the cooling water circulating pump is shut-down, i.e. without river water being circulated through the condenser, and distilled water condensate may be circulated through the condenser tubes instead of the river water which was used for cooling. Alternatively, air, preferably dehumidified air, may be circulated through the pump and through the condenser tubes to keep the condenser dry and clean. In this embodiment, the wand is moved laterally across the condenser face, as described above, and air is pumped forward through the shaft and through the condenser by pump 84. A pump and associated equipment for pumping dehumidified air through the system is known to those skilled in the art.

Control panel 27, shown in FIG. 1, includes a plurality of switches 29 for operating the system, including operation of the wand, valves, pistons, etc. Control panel 27 (including switches 29) may be remotely located for convenience. Switches 29 provide activation of each step of the process. Automation of the control system is within the scope of the invention.

While the invention has been described above with respect to certain embodiments thereof, it will be appreciated that variations and modifications may be made without departing from the spirit and scope of the invention.

What is claimed is:

1. A condenser cleaning system comprising:

a first hollow wand;

a hollow shaft attached to said hollow wand;

means for incrementally moving said wand;

means for extending said wand to adjacent the condenser face;

valve means for opening when said wand is extended adjacent the condenser face and for closing before moving said wand to a different position;

means for retracting said wand from adjacent the condenser face;

control means for incrementally moving said wand to a different position, extending said wand to adjacent the condenser face, opening said valve means, closing said valve means, and retracting said wand from the condenser face.

2. A condenser cleaning system according to claim 1 wherein said means for incrementally moving the wand comprises means for moving said wand laterally across the condenser face.

3. A condenser cleaning system according to claim 2 wherein said means for moving said wand comprise a carriage for supporting the wand as it is moved incrementally across the condenser face.

4. A condenser cleaning system according to claim 3 wherein said carriage moves on a track.

5. A condenser cleaning system according to claim 2 further comprising means for controlling the movement of the wand toward and away from the condenser face.

6. A condenser cleaning system according to claim 5 further comprising means for controlling the movement of the wand laterally across the condenser face.

7. A condenser cleaning system according to claim 1 wherein said hollow wand comprises an elongated, hollow member, open on a side which contacts the condenser face and closed at each end.

8. A condenser cleaning system according to claim 7 wherein said hollow shaft comprises a hollow pipe connected to said hollow wand.

9. A condenser cleaning system according to claim 8 wherein said hollow shaft is connected to a midpoint of said hollow wand.

10. A condenser cleaning system according to claim 9 wherein said hollow wand extends substantially perpendicularly to said hollow shaft.

11. A condenser cleaning system according to claim 10 wherein said hollow wand further comprises an extension swivellingly attached to one end of said hollow wand.

12. A condenser cleaning system according to claim 1 wherein said control means is operated automatically.

13. A condenser cleaning system according to claim 1 further comprising a pump communicating with said hollow shaft for pumping fluid through tubes of said condenser.

14. A condenser cleaning system according to claim 13 further comprising a second hollow wand having an open face substantially identical in size and shape to the face of the first hollow wand, said second hollow wand positioned on a remote side of said condenser face opposite said first hollow wand wherein said first hollow wand, said condenser tubes and said second hollow wand are in fluid communication for receiving cleaning fluid.

15. A condenser cleaning system according to claim 14 further comprising a recovery tank for receiving cleaning fluid from said second hollow wand and means for recycling cleaning fluid to said first hollow wand.

16. A method for cleaning trash from a face of a condenser cooled with a stream of water, comprising:

(a) providing a hollow wand having an elongated open face in a first position adjacent the condenser face in fluid connection with a hollow shaft attached to the wand;

(b) opening an outlet valve of the shaft for enabling trash adhering to the condenser face to pass in a stream of water from adjacent the condenser face back through the hollow wand and through the hollow shaft to a remote location;

(c) closing the valve;

(d) retracting the wand from adjacent the condenser face;

(e) moving the wand by an incremental amount to a different position;

(f) extending the wand to a second position adjacent the condenser face incrementally moved from the first position, and (g) successively repeating steps (a), (b), (c), (d), (e) and (f);

whereby the wand is moved in increments over the condenser face and segments of the condenser face are successively cleaned of trash.

17. A method according to claim 16 further comprising closing the outlet valve before retracting the wand.

18. A method according to claim 16 wherein step (e) comprises:

disengaging a mechanism for laterally moving the wand;

resetting said lateral movement mechanism; and reengaging said lateral movement mechanism.

19. A method according to claim 16 comprising moving the wand laterally in increments of about 5 to 9 ins.

20. A method according to claim 19 comprising moving the wand laterally in increments of about 6 to 8 ins.

21. A method according to claim 16 comprising successively retracting and extending the wand about 3 to 8 inches.

22. A method according to claim 21 comprising successively retracting and extending the wand about 4 to 6 inches.

23. A method according to claim 16 further comprising separating the trash from the stream of water carrying the trash at the remote location.

24. A method according to claim 16 further comprising automatic control means for incrementally moving the wand laterally across the condenser face.

25. A method according to claim 16 further comprising pumping chemical cleaning fluid through the shaft to the condenser, for cleaning thereof.

26. A method according to claim 25 wherein the chemical cleaning fluid comprises biocidal cleaning compounds.

27. A method according to claim 16 further comprising pumping abrasive-containing fluid through the shaft to the condenser for cleaning the condenser face and tubes.

28. A method for maintaining a condenser in dry condition when a circulating pump for circulating cooling water through the condenser is shut down, comprising:

(a) providing a hollow wand having an elongated open face in a first position adjacent the condenser face in fluid connection with a hollow shaft attached to the wand;

(b) opening a valve of the shaft and pumping air forward through the shaft and through the condenser;

(c) closing the valve;

(d) retracting the wand from adjacent the condenser face;

(e) incrementally moving the wand;

(f) extending the wand to a second position adjacent the condenser face, and (g) successively repeating steps (a), (b), (c), (d), (e) and (f);

whereby the wand is moved in successive increments over the condenser face for pumping air through the condenser.

29. A method according to claim 28 comprising pumping dehumidified air through the condenser.

30. A method for cleaning a condenser when a circulating pump for circulating cooling water through the condenser is shut down, comprising:

(a) providing a hollow wand having an elongated open face in a first position adjacent the condenser face in fluid connection with a hollow shaft attached to the wand;

(b) opening a valve of the shaft and pumping cleaning fluid forward through the shaft and the wand and through the condenser;

(c) closing the valve;

(d) retracting the wand from adjacent the condenser face;

(e) incrementally moving the wand;

(f) extending the wand to a second position adjacent the condenser face, and (g) successively repeating steps (a), (b), (c), (d), (e) and (f);

whereby the wand is moved in successive increments over the condenser face for pumping cleaning fluid through the condenser.

31. A method according to claim 30 comprising pumping cleaning fluid comprising at least one member selected from the group consisting of chemical cleaning fluids and abrasive cleaning fluids through the condenser.

32. A method according to claim 30 comprising providing a second incrementally movable hollow wand on a remote condenser face from the condenser face receiving the first hollow wand, said second hollow wand having an open face of substantially identical size and shape to the face of the first hollow wand, said second hollow wand being positioned in a first position adjacent the remote condenser face facing said first hollow wand on the first condenser face in fluid connection with a hollow shaft attached thereto and further in fluid connection through the condenser tubes with the first hollow wand;

whereby cleaning fluid passes successively through the first hollow wand, through the condenser tubes and through the second hollow wand to the hollow shaft attached thereto.

33. A method according to claim 31 further comprising recycling at least a portion of the cleaning fluid from the second hollow wand to the first hollow wand for reusing.

34. A method according to claim 33 further comprising recycling the cleaning fluid through a recovery tank.

* * * * *